United States Patent [19]

Farmer

[11] 4,103,051

[45] Jul. 25, 1978

[54] PILLING REDUCTION IN TEXTILES

[75] Inventor: Larry B. Farmer, Spartanburg, S.C.

[73] Assignee: Milliken Research Corporation, Spartanburg, S.C.

[21] Appl. No.: 628,268

[22] Filed: Nov. 3, 1975

[51] Int. Cl.[2] ..... B05D 3/02

[52] U.S. Cl. ..... 427/394; 8/196; 57/140 C; 264/211; 427/396

[58] Field of Search ..... 28/76 R; 57/140 C; 427/394, 396; 264/211; 8/196

[56] References Cited

U.S. PATENT DOCUMENTS

| | | | |
|---|---|---|---|
| 2,211,976 | 8/1940 | Habert et al. | 427/394 |
| 2,759,851 | 8/1956 | Fluck et al. | 427/394 |
| 2,897,042 | 7/1959 | Heiks | 427/394 X |
| 3,104,450 | 9/1963 | Christens et al. | 57/140 C |
| 3,396,446 | 8/1968 | Eggleston et al. | 28/76 R |

*Primary Examiner*—Michael R. Lusignan

*Attorney, Agent, or Firm*—Glen M. Burdick; H. William Petry

[57] ABSTRACT

A method for reducing the pilling tendency of textiles including polyester fibers which comprises subjecting the textile to an aliphatic amine having at least 10 carbon atoms, the concentration of the amine being between about 0.5% and 10% based on the dry weight of the textile.

8 Claims, No Drawings

PILLING REDUCTION IN TEXTILES

This invention relates to reducing the pilling tendency of textiles and particularly those articles including polyester fibers.

There is a tendency for textiles including polyester fibers to form small balls or pills on the surface of the textile during use. For example, when a polyester garment is worn, adjacent portions may rub against each other, e.g., the inside of the sleeves of a jacket against the sides of the body portion. This rubbing or abrasive action causes loose fibers to be drawn from the surface and form small balls or pills which detract from the appearance of the textile.

While textiles formed from many natural and synthetic fibers also form such pills, most of these fibers are of sufficiently low strength that the pills are torn free from the surface as they are formed. In such instances, the pilling tendency is not objectionable since it does not detract from the appearance of the textile. However, with textiles formed from certain fibers, such as polyester fibers, the pills which are formed adhere tightly to the surface so that over a period of time a large number of pills will be present on the surface of the textile. Removal of the pills is difficult and time consuming. One method of removing pills is to shave the surface with a razor, but this is not considered the answer since there is danger that the razor may slash the textile and render it unacceptable for use.

It has been suggested in U.S. Pat. No. 3,104,450 that the pilling tendency of polyester fibers may be reduced by controlling the relative viscosity of the starting polymer and also controlling the break elongation of the fibers produced from such a polymer. While this method may be useful for fiber producers, it limits the choice of starting fibers of the fabric manufacturer and does not permit a fabric manufacturer to reduce the pilling tendency of textiles formed from conventional polyester fibers.

U.S. Pat. No. 3,396,446 discloses the treatment of polyester fibers with super-heated steam or aqueous solutions of acids, ammonia, ammonia vapors or amines. The patent lists a 40% monomethyl amine solution as the example of an amine. While treatment with the above chemicals may provide a reduction in pilling, these chemicals have not been considered to be commercially useful. Either the chemicals are hazardous and require special equipment and handling procedures or they require high concentrations to be effective. In either case, disposal of chemicals after use may present a problem. In addition, these factors greatly increase the cost of the treatment.

The present invention provides a novel method for reducing the pilling tendency of textiles including polyester fibers which overcomes the problems of methods heretofore proposed. The concentration of the treating chemical is very low and no special equipment is required for the treatment. In fact, the treatment may be combined with common textile finishing operations, such as dyeing. Also, since the treating chemical has a low volatility, the method of the invention may be performed on conventional treating equipment without inhalation hazard. Furthermore, since only small concentrations of the chemical are required for short periods of time, the treatment of the textile may be performed as a continuous operation where a relatively short chemical contact time is a necessity.

The novel method of the present invention for reducing the pilling tendency of textiles, including polyester fibers, comprises subjecting the textile to an aliphatic amine having at least 10 carbon atoms. The concentration of the amine is between about 0.5% and 10% based on the dry weight of the textile.

The textile of the present invention, as pointed out above, includes polyester fibers. The polyester fibers may be used alone or in combination or blended with other natural or synthetic fibers. Examples of natural fibers include cotton, wool, linen, flax, etc. Suitable synthetic fibers include regenerated cellulosic fibers such as viscose rayon and other synthetic polymeric fibers such as polyamide, polyacrylic and similar fibers. The fibers may be in the form of filaments, stapel, yarns or fabrics.

The aliphatic amine employed in the pilling reduction method of the present invention is an amine in which the amino group is attached directly to a tetrahedrally bound carbon atom, but is not an alicyclic amine. The amine contains at least 10 carbon atoms with the maximum number of carbon atoms not being critical and will depend upon the melting point and/or the viscosity of the amine. Advantageously, the aliphatic amine contains between about 10 and 25 carbon atoms and preferably between about 12 and 21 carbon atoms. Fatty amines are preferred, particularly diamines.

The amine generally is dissolved or suspended in water or an organic solvent prior to the treatment of the textile. The proportion of the amine based on the dry weight of the textile is between about 0.5% and 10% and preferably between about 1% and 5%. In order to provide the beforementioned amount of amine on the textile, the treating admixture will generally contain from about 0.01 to about 20 weight percent of the amine.

The textile may be treated with the amine utilizing conventional application techniques such as padding, dipping, spraying, etc. Also, exhaustion techniques may be employed such as by adding the amine to a dye bath in a dyeing cycle. Advantageously, the treatment is performed at a temperature between about 200° and 400° F for a period between about 1 and 60 minutes.

Other chemicals may be applied to the textile simultaneously or sequentially of the amine. For example, chemicals may be employed which enhance the physical characteristics of the textile such as durable press reactants, e.g., textile resins or vinyl monomers with dual functionality and catalysts therefor, as well as soil release polymers, hand builders, softeners, emulsifying or wetting agents and the like.

The following examples illustrate preferred embodiments of the present invention but are not intended to restrict the scope thereof. In the examples, parts and percentages are by weight unless otherwise noted.

EXAMPLE I

Ten-gram samples of undyed and unheated 100% spun polyester woven fabric with a 80 × 44 sateen construction are treated with 250 milliliter aqueous mixtures containing 0.1% of each of the amines set forth in Table I. The fabric samples are maintained in the treating mixture in a closed container at 266° F for about 40 minutes, then rinsed with water, and air dried. A control sample is run wherein only water is used as the treating medium. After drying, all of the samples are heat set for 90 seconds at 400° F.

Each sample is then tested for pilling. The pilling test involves controlled rubbing of the fabric sample against an elastomeric pad with specially selected properties, and rating the tested specimens on an arbitrarily chosen scale ranging from 1.0 (severe pilling) to 5.0 (no pilling). The details of the pilling test are set forth in *Textile Chemist and Colorist,* Vol. 4, page 167 (1972).

The following results illustrate the unexpected superiority of aliphatic amines containing at least 10 carbon atoms as contrasted with the lower alkyl amines and cyclic amines.

TABLE I

| Compound Tested | Number of Carbon Atoms | Pilling Rating* |
|---|---|---|
| None (Control) | — | 1.0 |
| Methylamine | 1 | 1.5 |
| n-Propylamine | 3 | 1.0 |
| n-Amylamine | 5 | 1.8 |
| n-Heptylamine | 7 | 1.5 |
| n-Octylamine | 8 | 1.5 |
| n-Decylamine | 10 | 5.0 |
| n-Dodecylamine | 12 | 5.0 |
| n-Hexadecylamine | 16 | 4.0 |
| Cyclopentylamine | 5 | 1.0 |
| Cyclohexylamine | 6 | 1.0 |
| Cyclo-octylamine | 8 | 1.0 |
| n-Methylcyclodecylamine | 11 | 1.0 |
| Dicyclohexylamine | 12 | 2.5 |
| Benzylamine | 7 | 1.0 |
| Ethylenediamine | 2 | 1.0 |
| 1,4-Butanediamine | 4 | 1.0 |
| 1,6-Hexanediamine | 6 | 1.0 |
| 1,8-Octanediamine | 8 | 1.5 |
| 1,10-Decanediamine | 10 | 5.0 |
| 1,12-Dodecanediamine | 12 | 5.0 |
| n-Coco-1,3-propanediamine | 15 | 5.0 |
| n-Tallow-1,3-propanediamine | 21 | 5.0 |
| n-Oleyl-1,3-propanediamine | 21 | 5.0 |
| 1,2-Cyclohexanediamine | 6 | 1.0 |
| 1-Amino-2-aminomethyl-3,3,5-trimethylcyclopentane | 9 | 1.0 |
| 1,8-p-Menthanediamine | 10 | 2.0 |
| 4,4'-Methylene bis-(Cyclohexylamine) | 13 | 2.5 |
| m-Xylylenediamine | 8 | 1.0 |

*On a scale of 1.0 (Severe Pilling) to 5.0 (No Pilling)

EXAMPLE II

A 10-gram sample of undyed and unheatset single-knit jersey fabric constructed from a 12-count (cotton system) 100% polyester yarn is treated in a closed vessel with 250 milliliters of an aqueous solution containing 0.04% of N-Coco-1,3-propanediamine for 40 minutes at 266° F. The sample is then rinsed with clear water and dyed with a control sample using a conventional disperse dye — C. I. Disperse Blue 3. Both samples are subsequently air dried and heat set at 400° F for 90 seconds. When tested for pilling by the test described in EXAMPLE I, the treated sample rates 3.0 (even with the very low reagent concentration) as compared with the control sample having a rating of 1.0.

EXAMPLE III

A 10-gram sample of undyed and unheatset 100% spun polyester woven fabric with a 80 × 44 sateen construction is treated with 400 milliliters of an aqueous suspension containing 0.125% of 1, 12-Diamino-dodecane. The sample is maintained in the treating suspension at the boil for 1 hour, then rinsed and air dried. The sample is then heat set at 400° F for 90 seconds. When the sample is tested for pilling using the test described in EXAMPLE I, it rates 4.5 as compared with an untreated control which rates 1.0.

EXAMPLE IV

A 10-gram sample of undyed, unheatset 100% spun polyester woven fabric with a 65 × 47 twill construction is dyed in a closed vessel for 40 minutes at 266° F using the following bath:

1.0g./liter N-Coco-1,3-propanediamine
0.9g./liter Dimethyldicocoammonium Chloride (leveling agent)
1.6g/liter of a liquid Biphenyl Dye Carrier
0.1g./liter C. I. Disperse Blue 3 A control sample is dyed in a similar bath from which the N-Coco-1,3-propanediamine is omitted. The dyed samples are rinsed, dried and heatset for 90 seconds at 400° F. Both samples are dyed to a bright blue level shade. When tested for pilling by the test described in EXAMPLE I, the sample dyed in the presence of the N-Coco-1,3-propanediamine rates 5.0, whereas the control sample rates 2.0.

EXAMPLE V

The procedures of the preceding EXAMPLES I, II and III are repeated using blend fabrics of 50% polyester/50% cotton, 65% polyester/35% cotton and 80% polyester/20% cotton. The results of testing for pilling using the test described in EXAMPLE I show the same unexpected superiority for the aliphatic amines of the present invention.

The above description and examples show that the present invention provides a novel method for reducing the pilling tendency of textiles including polyester fibers. This method overcomes the problems of methods heretofore proposed. Only a very low concentration of the treating chemical is needed and no special equipment is required for the treatment. Also, the amine treatment may be combined with other textile finishing operations, such as dyeing. In addition, the method of the invention may be performed on conventional treating equipment without inhalation hazard since the the treating chemical has a low volatility. Furthermore, the treatment of the textile may be performed as a continuous operation where a relatively short chemical contact time is a necessity since only small concentrations of the chemical are required for short periods of time.

It will be apparent that variations and modifications can be made in the specific formulations and procedures described above. Therefore, the invention is to be limited only by the following claims.

That which is claimed is:

1. A method for reducing the pilling tendency of textiles containing polyester fibers which consists essentially of treating the textile with an effective amount of an aliphatic diamine having at least 10 carbon atoms to provide a concentration of the diamine on the textile of from about 0.5 to about 10 weight percent, based on the dry weight of the textile.

2. A method according to claim 1 wherein said aliphatic diamine has between about 10 and carbon atoms.

3. A method according to claim 1 wherein said textile is treated with said aliphatic diamine for between about 1 and 60 minutes at a temperature of from about 200° F to about 400° F.

4. A method according to claim 3 wherein said aliphatic diamine contains from about 12 and 21 carbon atoms, and the concentration of said diamine is from about 1% to about 5%.

5. A method for reducing the pilling tendency of textiles containing polyester fibers which comprises treating the textile material with a liquid admixture consisting essentially of a liquid carrier constituent selected from the group consisting of water and an organic solvent and from about 0.01 to about 20 weight percent of an aliphatic diamine containing at least about 10 carbon atoms at a temperature of from about 200° F to about 400° F for a period of time effective to substantially eliminate the pilling tendencies of the textile and drying the treated textile.

6. The method according to claim 5 wherein said textile is treated with said liquid admixture for a period of time of from about 1 minute to about 60 minutes.

7. The method according to claim 6 wherein said diamine contains from about 10 to about 25 carbon atoms.

8. The method of claim 7 wherein said diamine is a fatty diamine contains from about 12 to about 21 carbon atoms.

* * * * *

UNITED STATES PATENT OFFICE

CERTIFICATE OF CORRECTION

Patent No. 4,103,051 Dated July 25, 1978

Inventor(s) Larry B. Farmer

It is certified that error appears in the above-identified patent and that said Letters Patent are hereby corrected as shown below:

Column 4, line 36, delete the second word "the".

Column 4, line 55, after the word "and" insert the numeral --25--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*